United States Patent [19]

Haydon

[11] 4,231,247

[45] Nov. 4, 1980

[54] DENT STRAIGHTENING TOOL

[76] Inventor: Charles R. Haydon, No. 20, Seattle Motor Ct., 19326 Pacific Hwy. S., Seattle, Wash. 89188

[21] Appl. No.: 36,434

[22] Filed: May 7, 1979

[51] Int. Cl.[3] ..... B21D 1/12

[52] U.S. Cl. ..... 72/479; 72/705; 85/46

[58] Field of Search ..... 72/705, 479; 85/1 JP, 85/1 P, 46, 47

[56] References Cited

U.S. PATENT DOCUMENTS

| | | | |
|---|---|---|---|
| 1,114,135 | 10/1914 | Hafertep | 85/46 |
| 2,005,672 | 6/1935 | Chaffee | 85/46 |
| 2,172,258 | 9/1939 | Place | 85/46 |
| 2,251,495 | 8/1941 | Owens | 85/1 P |
| 2,791,926 | 5/1957 | Guyton | 72/705 |
| 3,100,336 | 8/1963 | Fannin | 72/705 |
| 3,109,691 | 11/1963 | Burkhardt | 85/1 P |
| 3,878,709 | 4/1975 | Chartier | 72/705 |
| 3,977,230 | 8/1976 | Jones | 72/705 |
| 4,034,594 | 7/1977 | Morgan | 72/705 |
| 4,122,699 | 10/1978 | Logsdon | 72/705 |

FOREIGN PATENT DOCUMENTS

| | | | |
|---|---|---|---|
| 106318 | 5/1917 | United Kingdom | 85/46 |

*Primary Examiner*—Lowell A. Larson
*Attorney, Agent, or Firm*—Graybeal & Uhlir

[57] ABSTRACT

A dent straightening tool having a manually graspable handle affixed to one end of an elongate shaft and a work piece engaging, helically threaded member affixed to the opposite end of the shaft. The threaded member has a substantially constant radius root with a blunt tip provided at the distal end of the root. The thread begins from a minimum radius at the blunt tip and then progressively increases in radius along the length of the root to attain a size substantially larger than the radius of the root so that the depth of the thread is substantially deeper than the radius of the root. Also, the flat length of the thread, as measured along the root, is at least one-half of the pitch length of the thread.

4 Claims, 6 Drawing Figures

DENT STRAIGHTENING TOOL

BACKGROUND OF THE INVENTION

1. Field of the Invention

This invention relates to a pull bar, and more particularly to a tool for use in straightening indentations in sheet metal walls or skins especially when limited or no access is available to the back side of the indentation, such as in automobile bodies or fenders.

2. Description of the Prior Art

Various types of tools have been used in an attempt to return indented sections of sheet metal, such as in an automobile fender, to original shape. One known type of such a tool generally includes an elongate shaft having a sheet metal or self-tapping screw attachable to one end thereof, a weighted sleeve slidable over the shaft, and a stop at the opposite end of the shaft. In use, the sheet metal screw is threaded into the damaged portion of the automobile fender or the like and then the weighted sleeve is slid along the shaft to impact against the stop to thereby impart an outwardly directed force to the indented sheet metal. Examples of this impact type tool are disclosed by Guyton U.S. Pat. No. 2,791,926; Chartier U.S. Pat. No. 3,878,709; and Morgan U.S. Pat. No. 4,034,594. Chartier also discloses replacing the rigid shaft with a flexible wire cable. However, the basic operation of the tool is similar to that described above.

In another type of dent straightening tool, such as disclosed by Jones U.S. Pat. No. 3,977,230, a backing member is placed in contact with the outward surface of the dented area of the sheet metal. A clearance hole is provided in the backing member through which a sheet metal screw can pass to threadably engage with the dented area of the sheet metal. Means are provided to pull outwardly on the sheet metal screw thereby simultaneously pushing inwardly on the backing plate to thus force the indented sheet metal outwardly against the inner surface of the backing plate. An obvious drawback of this particular dent straightening tool, as well as those described above, stems from the fact that all of these tools require the use of a standard sheet metal or self-tapping screw to engage with the indented sheet metal. Commonly available sizes of sheet metal and self-tapping screws have thread diameters which are substantially smaller than the indented areas of, for instance, most automobile dents. Thus, the process of threading the sheet metal screw into the indented area of the automobile body and then pulling outwardly on the sheet metal screw as described above may have to be repeated many times resulting in a slow, expensive procedure.

Furthermore, the thread diameter of standard sheet metal screws is not substantially larger than the corresponding root diameter of the screw, and thus the thread is often not capable of withstanding the impact load imparted on it, especially when used in conjunction with the shaft and sliding weight type of tool. As a result, the sheet metal screw often is simply disengaged from or jerked out from the indented sheet metal when the sliding weight impacts against the stop at the end of the shaft of the impact type tool.

Also, although the thread of a sheet metal screw is initially sharp, such thread is often not substantially harder than the material in which it is being threaded into. Thus, the thread often becomes dulled so rapidly that it is difficult to engage it into the dented sheet metal.

Moreover, many sheet metal structures, especially in automobile bodies, are constructed with an outer wall and a inner wall spaced inwardly of the outer wall. When the outer wall is indented, it is pushed inwardly to a location closely adjacent to or even actually in contact with the inner wall, with the result that when the sheet metal screw is threaded into the outer wall it often also pierces and engages with the inner wall. Thus, it is usually very difficult to return the outer wall to its original shape since the inner wall is also pulled outwardly with the outer wall.

SUMMARY OF THE INVENTION

The present invention relates to a novel sheet metal straightening tool especially useful for repairing dents in the metal skin of an automobile body or fender or for removing seals, plugs or the like. In basic form, the tool is comprised of an elongate shaft having an integral, manually graspable handle disposed at one end of the shaft and an integral work piece engaging member disposed at the opposite end of the shaft. In preferred form, the work piece engaging member comprises tapered, helical thread disposed along the length of a substantially constant diameter root. A blunt tip is provided at the distal end of the thread with the thread beginning from a minimum radius at such tip and progressively increasing in radius along the length of the root to a size substantially larger than the radius of the root so that the depth of the thread is considerably deeper than the radius of the root. Preferably, the thread is formed from tempered steel and has sharp edged crests so that when the tool is engaged within an initial hole provided in the indented sheet metal skin of a diameter slightly larger than the root diameter, a narrow slit is formed in the dented sheet metal to extend radially outwardly from the initial hole for a distance corresponding to the maximum radius of the thread. Once the tool is engaged into the work piece, the thread provides a substantial contacting anvil surface against which the indented sheet metal can bear when the tool is pulled in an outwardly direction.

It is a principal object of the present invention to provide a dent straightening tool which is easily insertable within a pilot hole provided in a dented sheet metal skin and which has a large anvil area that bears against the inside surface of the sheet metal when the tool is pulled in the outwardly direction to thereby quickly and conveniently restore the indented sheet metal to approximately its original configuration.

Another object of the present invention is to provide a dent straightening tool which is inexpensive to manufacture, convenient to use, and durable enough to be reused many times.

It is a further object of the present invention to provide a dent straightening tool which will not pierce or otherwise damage the inner wall of a double wall sheet metal structure.

An additional object of the present invention is to provide a dent straightening tool which in use will not mar the adjacent sheet metal area.

DETAILED DESCRIPTION

Figure 1:
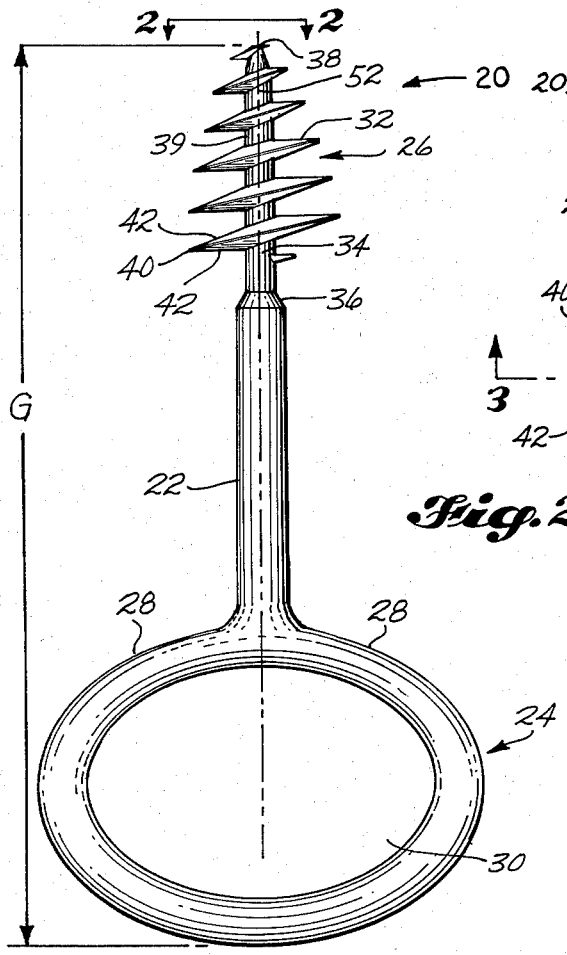
FIG. 1 is a side elevational view of one typical embodiment of the present invention.

Referring initially to FIG. 1, shown in side elevational view is a typical embodiment of dent straightening tool 20 constructed according to the present invention. In the preferred form illustrated, it comprises an elongate, straight shaft 22, a handle 24 affixed to one end of the shaft 22, and a work piece engaging, helically threaded member 26 affixed to the opposite end of shaft 22. More specifically, shaft 22 is formed from a metallic material, such as steel, and is preferably round in cross section. However, as will be apparent, other cross-sectional shapes such as square or hexagonal may also be used.

Figure 4:
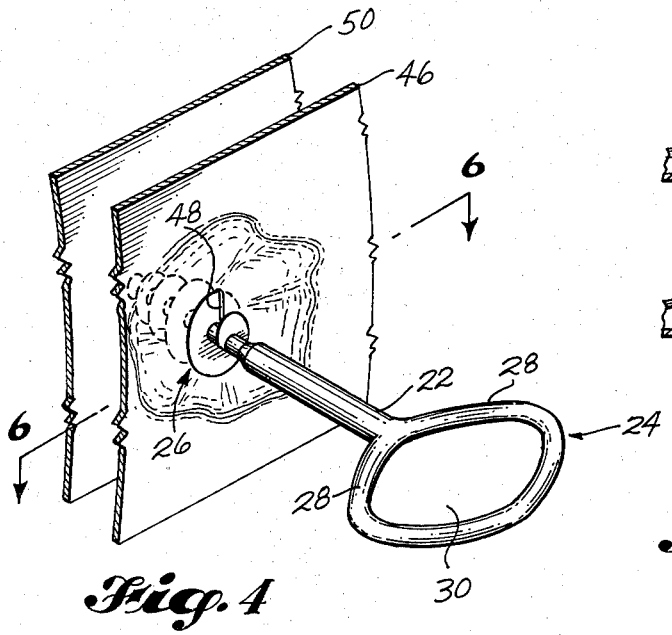
FIG. 4 is a reduced scale isometric view of a typical embodiment of the present invention shown engaged with the outer indented wall of a dual wall sheet metal structure.

Handle 24 is illustrated in FIGS. 1 and 4 as formed in the shape of a closed oval loop with the major diameter of the oval loop extending perpendicularly to the length of shaft 22 and the minor diameter aligned with the length of shaft 22. For economy of construction, handle 24 is preferably formed from the same type and diameter of material from which shaft 22 is formed. The oval loop of handle 24 is preferably sized to conveniently fit within the palm of the user's hand so that the user's fingers can either curl around the inward segments 28 of said handle 24 or alternatively extend through the opening 30 formed by handle 24.

Threaded member 26 includes specially shaped helical thread 32 which is aligned coaxially with the longitudinal axis of shaft 22 to extend lengthwise from the end of said shaft 22 opposite handle 24. Helical thread 32 has a substantial constant diameter root 34 which is of a size smaller than the diameter of shaft 22. The transition between the larger diameter shaft 22 and smaller diameter root 34 is accomplished by shoulder 36 which is located at the intersection of shaft 22 and threaded member 26. As perhaps best shown in FIG. 3, the distal or free end of root 34 tapers to a blunt tip or end 38. Thread 32 begins from a minimum radius at tip 38 and then progressively increases in radius along the length of root 34 to reach a maximum radius A which is substantially larger than the radius B of root 34 so that the maximum depth C of threads 32 is considerably deeper than the radius of root 34. Preferably, the maximum radius A of thread 32 is at least four times the radius B of root 34 thus resulting in the maximum depth C of thread 32 as being three times the radius B of root 34.

Unlike most conventional screw threads, the flat 39 of thread 32 is quite long in respect to the pitch length of said threads. Preferably, the length D of flat 39, as measured along the root of said threads, is at least one-half the pitch length E of said thread. Also, preferably the flat length D is equal to the radius B of root 34. Furthermore, the crests 40 of thread 32 are sharp rather than being rounded as in most screw threads. To prevent crests 40 from being dulled during use, thread 32 is preferably tempered or otherwise hardened to a hardness greater than that of most sheet metal forms, such as automobile fenders.

Figure 2:
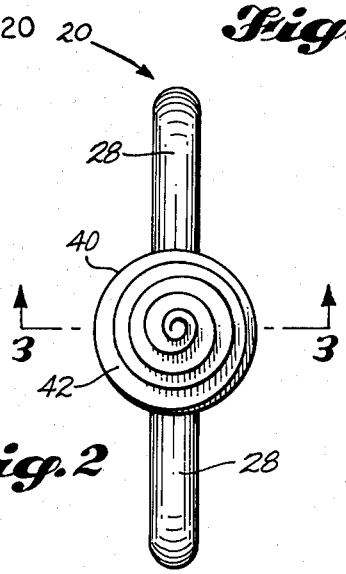
FIG. 2 is an end view of the present invention taken substantially along lines 2—2 of FIG. 1.
Figure 3:
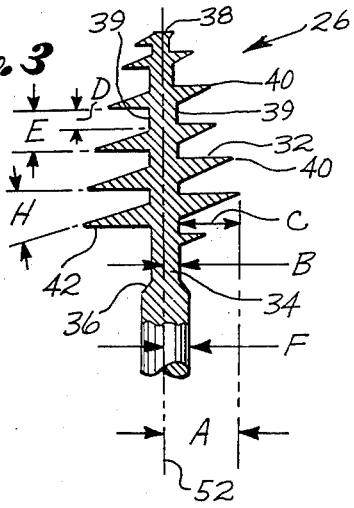
FIG. 3 is a fragmentary cross-sectional view of the threaded portion of the dent straightening tool taken substantially along lines 3—3 of FIG. 2.

In the preferred form illustrated in FIGS. 1–3, the maximum radius A of thread 32 is approximately one-half inch while the radius B of root 34 is one-eighth inch thereby resulting in a thread depth C of three-eighths of an inch. Thread 32 with these dimensions provides a substantial thread side surface or anvil surface area 42 against which a sheet metal skin can bear when tool 20 is being pulled outwardly. Preferably, the radius F of shaft 22 and handle 24 is about three-eighth inch while the total length G of tool 20 is approximately six inches. At that length, tool 20 is short enough to be conveniently used by a workman especially in cramped quarters. It is further preferred that the pitch length E of thread 32 is approximately one-quarter inch thereby resulting in a flat length D of approximately one-eighth of an inch. Since sheet metal skins or walls are generally thinner than one-eighth of an inch, they can conveniently fit within the flat length D to thereby bear against a major portion of anvil surface 42 of thread 32. Also, the relatively large maximum radius A of thread 32 with respect to the radius B of root 34 and the relatively large flat length D with respect to pitch length E results in thread 32 having a thread angle H which is more acute than the thread angles of conventional screw threads. Thus, anvil surface 42 of thread 32 is substantially perpendicular to the length of shaft 22 and thread 32.

In the preferred form of tool 20, handle 24, shaft 22 and threaded member 26 are all integrally formed. This type of construction is made possible by hardening thread 32 so that crests 40 remain sharp even after repeated use. Nevertheless, if so desired, threaded member 26 and even handle 24 could be adapted to be removable from shaft 22.

In use, a pilot hole 44 of a size slightly larger than the diameter of root 34 is initially drilled through the indented area of outer skin or wall 46. Threafter, tip 38 of tool 20 is inserted into pilot hole 44 and then tool 20 is twisted, for example, by grasping handle 24, so that thread 32 is engaged into outer wall 46. As tool 20 is twisted, the sharp crests 40 of thread 32 cut a narrow, clean slit 48 in outer wall 46, which slit 48 extends radially outwardly from pilot hole 44, as best shown in FIG. 4, a distance corresponding to the maximum radius of thread 32. Except for slit 48, no other portion of the sheet metal wall 46 surrounding pilot hole 44 is marred or otherwise damaged during the normal use of tool 20 to straighten dents.

Figure 6:
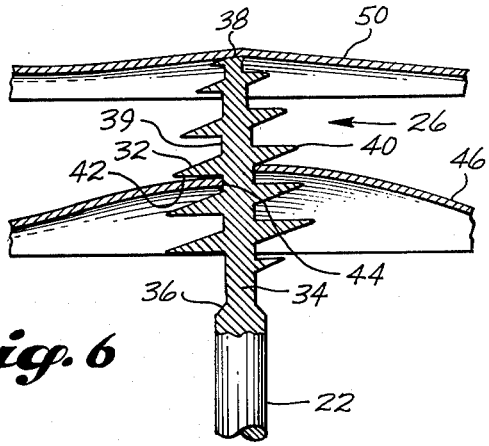
FIG. 6 is a view similar to FIG. 5, however with the typical dent straightening tool shown in fragmentary cross section.
Figure 5:
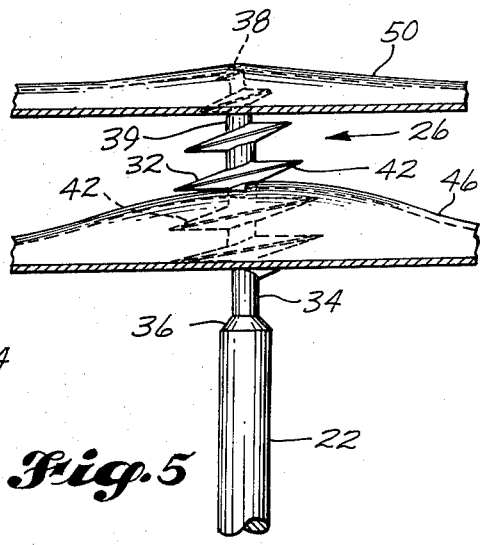
FIG. 5 is a top fragmentary view of the typical embodiment of the present invention shown in FIG. 4.

Many sheet metal structures, such as automobile body panels, are constructed with a double wall, an outer wall such as wall 46, and an inner wall such as wall 50, FIGS. 4–6. Thus, when a conventional fastener such as a self-tapping or sheet metal screw is threaded into outer wall 46, such fastener will often also pierce the inner wall 50, especially if the outer wall 46 is dented inwardly far enough to lie closely adjacent or even in contact with inner wall 50. However, when applicant's tool 20 is threaded through outer wall 46, the blunt tip 38 does not pierce inner skin 50. Furthermore, if tool 20 is twisted after blunt tip 38 has contacted against inner wall 50, as shown in FIGS. 5 and 6, such inner wall 50 will be pushed inwardly thereby creating an outwardly directed force upon outer wall 46 tending to restore such outer wall 46 to its normal configuration. However, continued twisting of tool 50 may cause inner wall 50 to be dented inwardly by blunt tip 38; but, since inner wall 50 is often hidden from view, the indentation of inner wall 50 may not be critical.

If the dented structure does not contain an inner wall 50 or if it is undesirable to form an inwardly directed bulge in inner wall 50, once thread 32 is engaged within outer wall 46, tool 20 can be conveniently pulled outwardly to thereby restore the outer wall 46 to its original or to nearly its original shape. To ensure that the maximum bearing area of thread 32 is utilized, it is preferable that before an outwardly pull is applied to tool 20, that substantially all of thread 32 be engaged within outer wall 46. With this amount of engagement, the anvil area 42 of thread 32 having substantially the largest radius A will be employed to push outwardly against outer wall 46.

If the access to the dented area of outer wall 46 is limited so that a direct pull cannot be applied to tool 20 or if the dent is so severe that wall 46 cannot be forced outwardly by simply pulling on tool 20 by hand, a hook or a pull chain, or alternatively a pry bar, can be inserted through handle 24 so that additional leverage can be applied to tool 20. Since thread 32 is hardened, it is preferable that a sharp impact load not be applied to such thread or else the thread may fracture.

From the above description, it can be appreciated that the specific configuration of thread 32 provides a relatively large thread side surface area 42, i.e. an effective anvil area, against which the outer wall 46 can bear when tool 20 is being pulled outwardly, thereby minimizing the likelihood that thread 32 will "strip out" or otherwise become disengaged from outer wall 46. Also, the sharp crests 40 of thread 32 ensures that, other than initial pilot hole 44, only a small slit 48 is formed in the dented area of wall 46 when thread 32 is engaged with outer wall 46. As a result, only a minimum of additional repair, as by patching with epoxy filler or solder, is required once the dent is pulled out. Damage to the dented area of outer wall 46 is also minimized by the fact that anvil surface 42 is nearly perpendicular to the axis 52 of thread 32. Thus, since said surface 42 closely corresponds to the plane of outer wall 46, the likelihood that a localized outwardly extending deformation in wall 46 will be caused when tool 20 is pulled outwardly is minimized. Moreover, by hardening threads 32, tool 20 strongly resists breakage and the crests 40 remain sharp much longer than would otherwise be the case, so that the tool can be reused indefinitely.

What is claimed is:

1. A tool for use in straightening a dent in a sheet metal skin, comprising:

(a) an elongate shaft;

(b) an integral handle at one end of said shaft; and (c) work piece engaging, helical threads integrally formed in the opposite end of said shaft, said threads comprising, (1) a substantial constant diameter root portion;

(2) a tapered thread portion disposed along the length of said root;

(3) a blunt tip at the distal end of said thread portion opposite said handle; and (4) said thread portion beginning from a minimum radius at said tip and progressively increasing in radius along the length of said root to a depth substantially greater than the radius of said root portion to thereby provide a thread with a relatively large anvil surface area disposed substantially perpendicular to the length of said root, so that when the tool is threadably engaged within an initial hole provided in the dented sheet metal of a diameter slightly larger than the root diameter, only a narrow slit is formed in the dented sheet metal extending radially from the initial hole for a distance corresponding to the maximum radius of said threads to thereby provide a substantial anvil contacting surface against which the dented sheet metal can bear when the tool is pulled in an outwardly direction.

2. A dent straightening tool according to claim 1, wherein the maximum depth of said thread is at least three times the radius of the root, and the distance separating adjacent thread convolutions as measured longitudinally along the circumference of the root is at least one-half the pitch length of said thread.

3. A dent straightening tool according to claim 2, wherein said thread tapers from said root through the full depth of said thread to form a sharp edge at the crest of said thread.

4. A dent straightening tool according to claim 3, wherein said thread is formed from tempered steel.

* * * * *